US008245473B2

(12) United States Patent
Schacht

(10) Patent No.: US 8,245,473 B2
(45) Date of Patent: Aug. 21, 2012

(54) FINISHING PROFILE FOR A FLOOR COVERING AND METHODS FOR MANUFACTURING SUCH FINISHING PROFILE

(75) Inventor: Benny Schacht, Vlamertinge (BE)

(73) Assignee: Flooring Industries Limited, Sarl, Bertrange (LU)

( * ) Notice: Subject to any disclaimer, the term of this patent is extended or adjusted under 35 U.S.C. 154(b) by 313 days.

(21) Appl. No.: 12/223,161

(22) PCT Filed: Jan. 25, 2007

(86) PCT No.: PCT/IB2007/000228

§ 371 (c)(1),
(2), (4) Date: Jul. 24, 2008

(87) PCT Pub. No.: WO2007/091138

PCT Pub. Date: Aug. 16, 2007

(65) Prior Publication Data

US 2010/0218448 A1 Sep. 2, 2010

(30) Foreign Application Priority Data

Feb. 7, 2006 (BE) ..... 2006/0074

(51) Int. Cl.
*E04F 15/14* (2006.01)

(52) U.S. Cl. ..... 52/468; 52/100; 52/717.04

(58) Field of Classification Search ..... 52/98, 99, 52/100, 108, 288.1, 463, 464, 466–470, 717.04, 52/718.01, 718.04

See application file for complete search history.

(56) References Cited

U.S. PATENT DOCUMENTS

| | | | | |
|---|---|---|---|---|
| 1,357,713 | A | 11/1920 | Lane | |
| 2,363,429 | A | 11/1944 | Lowry | |
| 2,449,904 | A | 9/1948 | Lorraine | |
| 2,996,751 | A | 8/1961 | Roby et al. | |
| 3,199,258 | A | 8/1965 | Jentoft et al. | |
| 3,254,361 | A | 6/1966 | Brunn et al. | |
| 3,296,056 | A * | 1/1967 | Bechtold | 156/461 |
| 3,303,626 | A | 2/1967 | Brigham | |
| 3,339,329 | A | 9/1967 | Berg | |
| 3,411,977 | A | 11/1968 | Slater, Jr. | |
| 3,543,326 | A | 12/1970 | Rohrberg et al. | |

(Continued)

FOREIGN PATENT DOCUMENTS

BE 1016403 10/2006

(Continued)

OTHER PUBLICATIONS

Machine translation for EP 0862976.*

*Primary Examiner* — Christine T Cajilig
(74) *Attorney, Agent, or Firm* — Bacon & Thomas, PLLC

(57) ABSTRACT

Finishing profile for a floor covering, wherein this finishing profile comprises a body with at least two portions made separable from each other, which, in the unseparated condition, are connected to each other by means of a break-off or cut-off zone, wherein, by whether or not removing one or more of the aforementioned two portions, various application possibilities of the remaining portion of the body are created, wherein, at least on the aforementioned two portions of the body, a layer-shaped covering is provided, wherein said layer-shaped covering shows an interruption at least over part of the length of the finishing profile, at the height of the transition between said two portions.

15 Claims, 4 Drawing Sheets

U.S. PATENT DOCUMENTS

| | | | | |
|---|---|---|---|---|
| 3,590,541 | A | 7/1971 | Epstein et al. | |
| 3,671,369 | A * | 6/1972 | Kvalheim et al. | 428/105 |
| 3,688,460 | A | 9/1972 | Van Loghem et al. | |
| 3,696,575 | A | 10/1972 | Armstrong | |
| 4,059,933 | A | 11/1977 | Funk et al. | |
| 4,067,155 | A | 1/1978 | Ruff et al. | |
| 4,198,455 | A * | 4/1980 | Spiro et al. | 428/126 |
| 4,289,818 | A * | 9/1981 | Casamayor | 428/43 |
| 4,385,850 | A | 5/1983 | Bobath | |
| 4,478,660 | A | 10/1984 | Landler et al. | |
| 4,557,779 | A | 12/1985 | Bower et al. | |
| 4,653,138 | A | 3/1987 | Carder | |
| 4,707,894 | A | 11/1987 | Friedwald | |
| 5,074,089 | A | 12/1991 | Kemmer et al. | |
| 5,155,952 | A | 10/1992 | Herwegh et al. | |
| 5,203,941 | A | 4/1993 | Spain et al. | |
| 5,391,340 | A | 2/1995 | Mirous et al. | |
| 5,551,201 | A | 9/1996 | Anderson | |
| 5,700,555 | A | 12/1997 | Grill | |
| 5,706,623 | A | 1/1998 | Brown | |
| 5,765,318 | A * | 6/1998 | Michelsen | 52/98 |
| 5,794,399 | A | 8/1998 | Searer | |
| 5,858,522 | A | 1/1999 | Turk et al. | |
| 5,939,670 | A | 8/1999 | Shteynberg et al. | |
| 6,038,733 | A | 3/2000 | Carder et al. | |
| 6,110,316 | A | 8/2000 | Kobayashi et al. | |
| 6,141,920 | A | 11/2000 | Kemper | |
| 6,230,385 | B1 | 5/2001 | Nelson | |
| 6,286,920 | B1 | 9/2001 | Ridgway | |
| 6,321,454 | B1 | 11/2001 | Wass | |
| 6,345,480 | B1 | 2/2002 | Kemper et al. | |
| 6,357,192 | B1 | 3/2002 | Schluter | |
| 6,383,594 | B2 * | 5/2002 | Weinstein et al. | 428/43 |
| 6,438,914 | B1 | 8/2002 | Robertson | |
| 6,517,935 | B1 | 2/2003 | Kornfalt et al. | |
| 6,523,986 | B1 | 2/2003 | Hoffmann | |
| 6,550,192 | B1 | 4/2003 | Nelson et al. | |
| 6,565,919 | B1 | 5/2003 | Hansson et al. | |
| 6,588,165 | B1 | 7/2003 | Wright | |
| 6,641,696 | B1 | 11/2003 | Edgerton | |
| 6,685,993 | B1 | 2/2004 | Hansson et al. | |
| 6,699,352 | B2 | 3/2004 | Sawatsky | |
| 6,737,122 | B2 | 5/2004 | Beck et al. | |
| 6,745,534 | B2 | 6/2004 | Kornfalt | |
| 6,805,951 | B2 | 10/2004 | Kornfalt et al. | |
| 6,860,074 | B2 | 3/2005 | Stanchfield | |
| 6,898,911 | B2 | 5/2005 | Kornfalt et al. | |
| 6,964,722 | B2 | 11/2005 | Taylor et al. | |
| 7,001,016 | B2 | 2/2006 | Baxter et al. | |
| 7,081,300 | B2 | 7/2006 | Laurence et al. | |
| 7,207,143 | B2 | 4/2007 | Stanchfield | |
| 7,640,706 | B2 | 1/2010 | Stanchfield | |
| 7,814,720 | B2 * | 10/2010 | Neuhofer | 52/471 |
| 2002/0061389 | A1 | 5/2002 | Brooker et al. | |
| 2003/0024190 | A1 | 2/2003 | Stanchfield | |
| 2003/0033766 | A1 * | 2/2003 | Smythe, Jr. | 52/255 |
| 2003/0051426 | A1 | 3/2003 | Kornfalt | |
| 2003/0084634 | A1 | 5/2003 | Stanchfield | |
| 2003/0118812 | A1 | 6/2003 | Kornfalt et al. | |
| 2003/0154678 | A1 | 8/2003 | Stanchfield | |
| 2003/0159389 | A1 | 8/2003 | Kornfalt et al. | |
| 2003/0218663 | A1 | 11/2003 | Baxter et al. | |
| 2004/0007892 | A1 | 1/2004 | Harata et al. | |
| 2004/0026017 | A1 | 2/2004 | Taylor et al. | |
| 2004/0029030 | A1 | 2/2004 | Murray | |
| 2004/0206038 | A1 | 10/2004 | Stanchfield | |
| 2004/0258907 | A1 | 12/2004 | Kornfalt et al. | |
| 2005/0003149 | A1 | 1/2005 | Kornfalt et al. | |
| 2005/0150182 | A1 * | 7/2005 | Stanchfield | 52/459 |
| 2005/0166526 | A1 | 8/2005 | Stanchfield | |
| 2005/0217193 | A1 | 10/2005 | Kornfalt et al. | |
| 2005/0229517 | A1 | 10/2005 | Gomez Insa | |
| 2005/0247216 | A1 | 11/2005 | Reichwein et al. | |
| 2005/0249923 | A1 | 11/2005 | Reichwein et al. | |
| 2005/0249924 | A1 | 11/2005 | Reichwein et al. | |
| 2005/0249929 | A1 | 11/2005 | Reichwein et al. | |
| 2006/0260241 | A1 * | 11/2006 | Stanchfield | 52/459 |
| 2007/0107342 | A1 | 5/2007 | Friedlich | |
| 2007/0125021 | A1 * | 6/2007 | Thiers et al. | 52/288.1 |
| 2008/0075859 | A1 | 3/2008 | Baker et al. | |

FOREIGN PATENT DOCUMENTS

| | | | | |
|---|---|---|---|---|
| CN | 2495741 | Y | | 6/2002 |
| DE | 36 00 318 | A1 | | 7/1987 |
| DE | 36 40 822 | A1 | | 6/1988 |
| DE | 37 07 045 | A1 | | 9/1988 |
| DE | 93 01 717.0 | | | 5/1993 |
| DE | 93 01 719.7 | | | 6/1993 |
| DE | 297 11 389 | U1 | | 10/1997 |
| DE | 198 00 517 | C1 | | 8/1999 |
| DE | 198 54 452 | A1 | | 5/2000 |
| DE | 100 30 092 | A1 | | 6/2001 |
| DE | 202 06 101 | U1 | | 10/2002 |
| DE | 203 20 273 | U1 | | 10/2004 |
| DE | 20 2004 018 094 | U1 | | 3/2005 |
| DE | 200 23 643 | U1 | | 5/2005 |
| DE | 20 2005 004 624 | U1 | | 8/2005 |
| EP | 0 092 040 | | | 2/1983 |
| EP | 0 788 576 | | | 8/1997 |
| EP | 0862976 | | * | 9/1998 |
| EP | 1 010 836 | A2 | | 11/1999 |
| EP | 1 113 124 | A2 | | 11/2000 |
| EP | 1 310 613 | A2 | | 10/2002 |
| EP | 1 319 578 | A2 | | 12/2002 |
| EP | 1 493 880 | A2 | | 6/2004 |
| EP | 1 593 797 | A2 | | 5/2005 |
| GB | 2 121 465 | A | | 12/1983 |
| GB | 2 398 579 | A | | 8/2004 |
| JP | 11-42610 | A | | 2/1999 |
| JP | 2000-210909 | A | | 8/2000 |
| JP | 2004-211469 | | | 7/2004 |
| WO | 96/12857 | A1 | | 5/1996 |
| WO | WO 97/47834 | | | 12/1997 |
| WO | 00/14351 | A1 | | 3/2000 |
| WO | 01/20101 | A1 | | 3/2001 |
| WO | WO 01/20101 | A1 | | 3/2001 |
| WO | 01/86091 | A1 | | 11/2001 |
| WO | 03/040492 | A1 | | 5/2003 |
| WO | 2005/083195 | A1 | | 9/2005 |
| WO | 2005-083196 | A1 | | 9/2005 |
| WO | WO 2005/083195 | | * | 9/2005 |
| WO | WO 2005/083195 | A1 | | 9/2005 |
| WO | WO 2005/083196 | | * | 9/2005 |
| WO | 2006-038866 | A1 | | 4/2006 |
| WO | 2006-079468 | A1 | | 8/2006 |
| WO | WO 2006/110934 | A2 | | 10/2006 |

* cited by examiner

FINISHING PROFILE FOR A FLOOR COVERING AND METHODS FOR MANUFACTURING SUCH FINISHING PROFILE

BACKGROUND OF THE INVENTION

1. Field of the Invention

The present invention relates to a finishing profile for a floor covering, as well as to a method for manufacturing such finishing profile.

2. Related Art

More particularly, the invention relates to finishing profiles that can be employed there, where an edge of a floor covering must be finished. Herein, this relates to any type of floor covering, however, preferably the finishing profiles of the invention are applied when finishing a floatingly installed floor covering, such as, for example, when finishing glue-lessly installed flooring of the type known, for example, from the WO 97/47834, namely, laminate panels, prefabricated parquet, veneer parquet or solid parquet.

Profiles that allow finishing an edge of such floor covering are known from the state of the art, for example, from U.S. Pat. No. 6,745,534. Usually, such finishing profile is performed as a decorative strip, whether or not consisting of several parts, or the like, which can be pressed on in a rail-shaped profile or holder by means of an attachment portion.

Currently, a difference is made between some three kinds of possible finishing modes and associated finishing profiles.

According to a first possibility, the finishing profile relates to a so-called expansion profile, which usually is applied for finishing a joint, said joint being intended, for example, as an expansion joint, between two floor coverings of an equal or similar type.

According to a second possibility, the finishing profile relates to a so-called transition profile, which usually is applied for forming a transition from one type of floor covering to another type of floor covering, such as, for example, a transition from a laminate flooring to a carpet or a transition between laminate floorings of different thicknesses.

According to a third possibility, the finishing profile relates to a so-called end profile, which usually is used for finishing an edge of a floor covering next to a wall. Generally, in the above by "floor coverings of another type", floor coverings are meant having a different thickness.

In the meantime, amongst others, from WO 01/20101 and U.S. Pat. No. 6,860,074, finishing profiles are known that allow finishing several kinds of transitions. To this aim, according to these documents, they have to be composed from several portions to form different configurations, depending on the required kind of finishing.

In the Belgian patent application BE 2005/0015, filed by the present applicant, finishing profiles have already been described, which allow to finish several kinds of transitions. According to BE 2005/0015, different configurations of one and the same finishing profile may be obtained by separating one or more portions from the finishing profile. Herein, the separation may take place, amongst others, by cutting through a layer-shaped covering provided on the finishing profile. However, the inventor of the present invention has found that in certain cases, it remains difficult to form a well-cut edge at the layer-shaped covering, for example, when not using a knife designed in particular to this aim. Also with embodiments in which is intended to break off one or more portions of the finishing profile instead of cutting them off, wherein the break line is realized also through the layer-shaped covering, the disadvantage is created that that the risk is rather high that the layer-shaped covering is damaged at the broken-off edge or is delineated in a rather un-esthetic manner.

SUMMARY OF THE DISCLOSURE

In order to remedy this, the present invention aims at a finishing profile in which, when separating a portion of this finishing profile, the risk of obtaining a top layer delineated in a less qualitative manner is minimized or excluded. To this aim, the invention relates to a finishing profile for a floor covering, wherein this finishing profile comprises a body with at least two portions made separable from each other, which, in the unseparated condition, are connected to each other by means of a break-off or cut-off zone, wherein, by whether or not removing one or more of the aforementioned two portions, various application possibilities of the remaining portion of the body are created, wherein, at least on the aforementioned two portions of the body, a layer-shaped covering is provided, with as a characteristic that said layer-shaped covering shows an interruption at least over part of the length of the finishing profile, at the height of the transition between said two portions, and preferably at the height of said break-off or cut-off zone.

Herein, by an "interruption" is meant that the layer-shaped covering as such is completely interrupted in the depth for at least a portion or portions of the length of the finishing profile, or, in other words, that the interruption extends across the material layer of the layer-shaped covering. However, this does not exclude that the layer-shaped covering, at the height of the interruption, may be composed of overlapping portions; according to the present invention, in such case the layer-shaped covering also has to be considered interrupted.

With a finishing profile according to the present invention, a better result is achieved, in particular in relation to the quality of the remaining portion after a possible separation has taken place, whereas a universal utilization of the finishing profile still remains possible.

It is noted that the application of the finishing profiles of the invention is not restricted to the above-described utilization possibilities or to the application thereof for the above-described types of floor coverings, although they preferably allow for at least two of the above-described utilization possibilities, of which, still better, at least one utilization possibility relates to the application of said remaining portion as an expansion profile.

Preferably, said interruption of the layer-shaped covering is provided locally, and still better, the two portions of the layer-shaped covering, these are the portions at opposite sides of the aforementioned interruption, adjoin closely and/or is the distance between both portions of the layer-shaped covering smaller than one millimeter. In this way, it is obtained that, in the case that in the desired configuration or utilization possibility of the finishing profile, the respective separable portions of the body do not have to be separated, this interruption is hardly apparent.

It is noted that according to the invention, a layer-shaped covering of any kind can be applied. So, for example, may the layer-shaped covering consist of a film, laminate, veneer, lacquer, ink or similar. When a finishing profile according to the invention comprises a layer-shaped covering consisting of a laminate, all difficulties imparted by a possible breaking-off or cutting-off of this laminate are avoided. So, for example, is it known that such laminate comprises a resin-immersed layer that may have abrasion-resistant features. These abrasion-resistant features are mostly obtained in that hard particles, such as aluminum oxide or the like, are incorporated in the laminate. The application of such laminate for a finishing profile of the invention is of particular importance, in view of the fact that in this case, too, a good result may be obtained in a simple manner.

In the most preferred embodiments of the invention, said two portions of the body are integrally connected to each other at the location of said break-off zone, still better the two portions as such, including the break-off zone, are performed in one piece and/or the entire body is made in one piece. According to these preferred embodiments, it is obtained that separate and/or integrated connection elements between said two portions are not necessary, which may result in a simple and/or inexpensive manufacture of the finishing profiles of the invention.

As will become evident from the further introduction and the description, the invention is not limited to finishing profiles with a body, of which latter solely two portions are made mutually separable. When the body comprises three or more separable portions and/or is provided with two or more break-off or cut-off zones where these portions may be separated from each other, the layer-shaped covering preferably, at least over a portion of the length of the finishing profile, comprises an interruption at the height of each of the transitions between said three portions, and preferably at the height of each of the aforementioned break-off or cut-off zones.

It is noted that the aforementioned interruption, interruptions, respectively, may extend, whether continuously or not, over the entire length of the finishing profile. It is clear that the presence of such, whether or not continuous, interruptions over the entire length of the finishing profile yields an optimum result with a possible separation of a portion of the body.

The finishing profiles of the invention may be manufactured in any manner. However, the present invention also relates to two inventive possibilities for realizing such finishing profile.

According to a first possibility, the invention relates to a method for manufacturing such finishing profile, starting from a carrier from which said body is formed and which is provided, at least partially, with said layer-shaped covering, with as a characteristic that said layer-shaped covering is provided as a single whole on the aforementioned two mutually separable portions and that said interruption, interruptions, respectively, is effected after providing the layer-shaped covering. This first possibility offers an inexpensive and/or simple manufacturing mode for such finishing profile.

In a particular case, wherein the layer-shaped covering shows a printed pattern or other pattern and the interruption is relatively thin or is local, it is obtained, according to this first possibility, in a simple manner that the aforementioned pattern still extends, practically seen, continuously over the interruption. It is noted that the pattern does not necessarily have to be obtained artificially, for example, by printing, however also may relate to a natural pattern, such as it is the case, for example, when veneer is applied as a layer-shaped covering. Preferably, the aforementioned pattern is adapted to the floor covering with which the finishing profile has to cooperate, and possibly may represent a wood pattern or a stone pattern.

According to a second possibility, the invention relates to a method for manufacturing such finishing profile, starting from a carrier from which said body is formed and which is provided, at least partially, with said layer-shaped covering, with as a characteristic that said layer-shaped covering is provided separately on each of the aforementioned two mutually separable portions. By applying a method according to this second possibility, a separate processing in order to provide said interruption is not necessary. Also, by means of this method, a close adjoining between both portions of the layer-shaped covering may be obtained in a simpler manner, such that the interruption may be performed in such a manner that it is hardly visible.

According to a first preferred form of embodiment of both possibilities, said body is formed from said carrier after the layer-shaped covering has been applied.

According to a second preferred form of embodiment of both possibilities, said body or said carrier, from which the body is obtained, is formed by extrusion prior to applying the layer-shaped covering.

For the body of the finishing profiles of the invention, use can be made of any material, such as, for example, composite material consisting of wood particles and a binding agent, MDF or HDF (Medium Density Fiberboard or High Density Fiberboard), plywood, paper pulp, synthetic material, metal, such as aluminum, or the like.

Various other preferred forms of embodiment of finishing profiles and methods for the manufacture thereof are possible. In this respect, reference is made to the detailed description and appended claims.

BRIEF DESCRIPTION OF THE DRAWINGS

With the intention of better showing the characteristics of the invention, hereafter, as an example without any limitative character, several preferred embodiments are described, with reference to the accompanying drawings, wherein.

DETAILED DESCRIPTION OF PREFERRED EMBODIMENTS OF THE INVENTION

Figure 1:
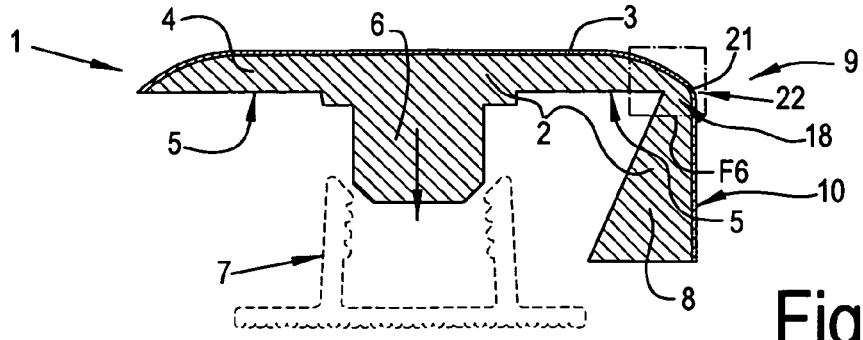
FIG. 1 in cross-section represents a finishing profile according to the invention.

FIG. 1 represents a finishing profile 1 with the characteristics of the invention. The finishing profile 1 consists of a body 2, which is provided with a layer-shaped covering 3. Said body 2 comprises, on the one hand, a flange-shaped portion 4 with an attachment portion 6 situated at the bottom side 5, with which attachment portion it can be fixedly pressed into a holder 7, and, on the other hand, a nose portion 8 extending downward from the flange-shaped portion 4.

Figure 2:
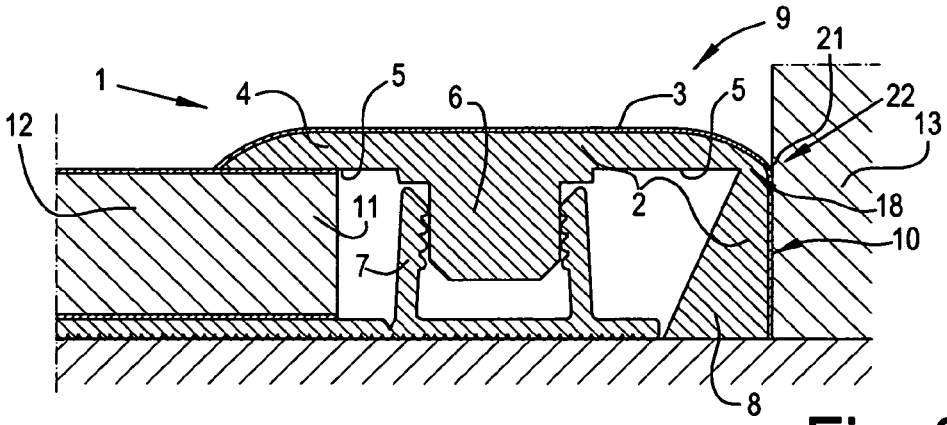
FIG. 2 represents an application or utilization possibility of the finishing profile from FIG. 1.

The finishing profile 1 of FIG. 1 shows the typical global form of a so-called end profile 9. To this aim, the nose portion 8 has a relatively steep lateral decorative side 10. As represented in FIG. 2, such finishing profile 19 usually is applied for finishing an edge 11 of a floor covering 12 next to a wall 13, wherein the aforementioned lateral decorative side 10 then is intended for adjoining against said wall 13.

Figure 3:
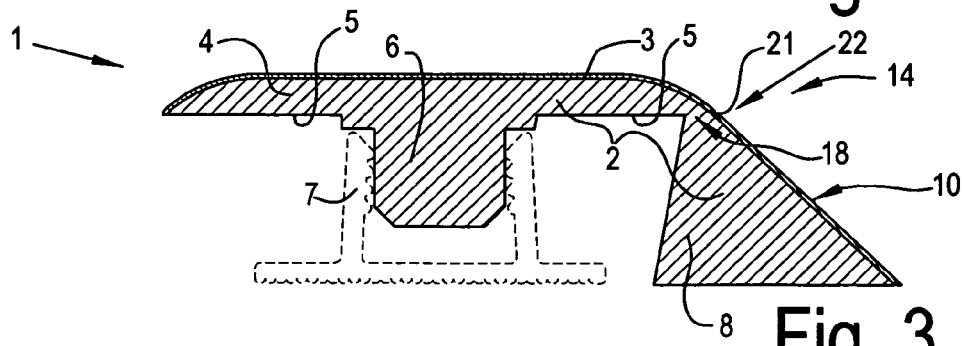
FIGS. 3 and 4 represent a variant of a finishing profile according to the invention and an application thereof.
Figure 4:
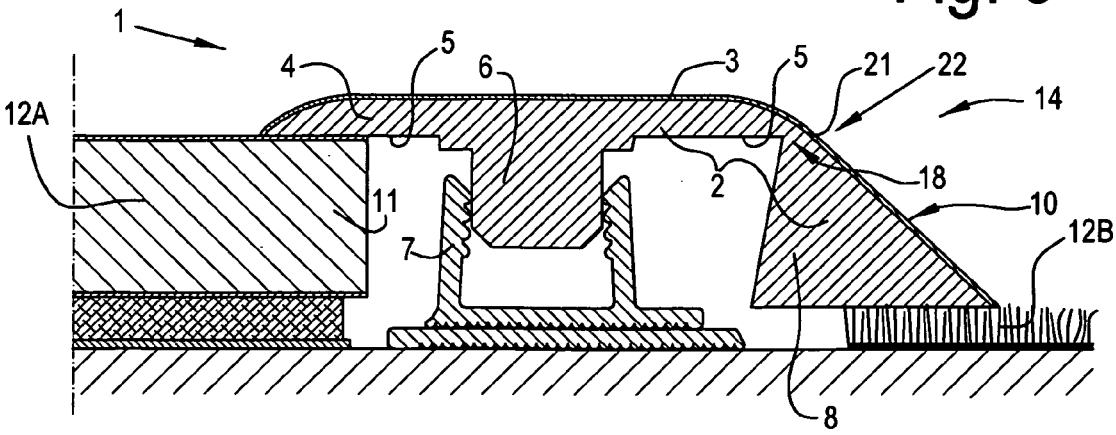

The variant of FIG. 3 also comprises a body 2 with such flange-shaped portion 4 and a nose portion 4, which, in this case, extends laterally and downward from the flange-shaped portion 4, however, rather has the typical global form of a so-called transition profile 14. To this aim, the nose portion 8 has a lateral decorative side 10, which, in comparison to the nose portion 8 of FIG. 2, globally is less steep. As represented in FIG. 4, such finishing profile 1-14 usually is applied with a transition from one type of floor covering 12A to another type of floor covering 12B, such as here, for example, a transition between a laminate flooring 12*a* and a fitted carpet 12B, wherein the nose portion 8 with said lateral decorative side 10 is intended for bridging-over the height difference between both types of floor covering 12A-12B caused, in this case, by their differing thickness.

Figure 5:
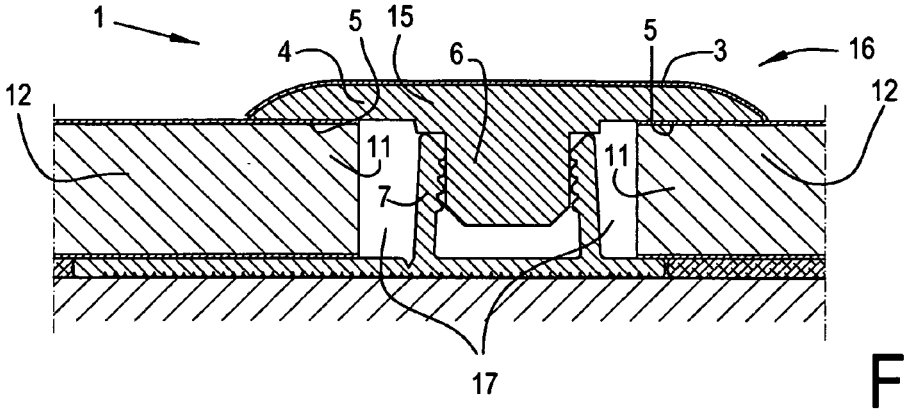
FIG. 5 represents another application of the finishing profiles from FIGS. 1 and 3.

In the example of FIGS. 1 and 2 as well as in the example of FIGS. 3 and 4, the flange-shaped portion 4 and the respective nose portion 8 are made separable from each other, wherein, by removing the nose portion 8, a different utilization possibility of the remaining portion 15 of the body 2, in this case, the flange-shaped portion 4, is created. In both examples, the flange-shaped portion 4-15 as such may be applied as a so-called expansion profile 16. As represented in FIG. 5, such flange-shaped portion 4 or remaining portion 15 of the finishing profile 1 may be applied for finishing a joint 17 between two floor coverings 12. Herein, the flange-shaped portion 4 adjoins with the bottom side 5 of its two flanges against the respective floor coverings 12.

Figure 6:
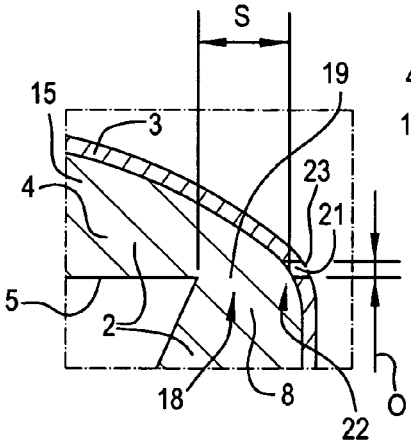
FIGS. 6 to 8, at a larger scale, represent the part indicated by F6 in FIG. 1.
Figure 7:
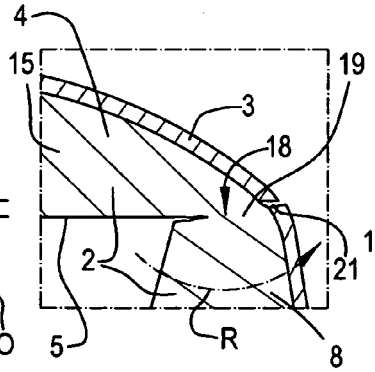
Figure 8:
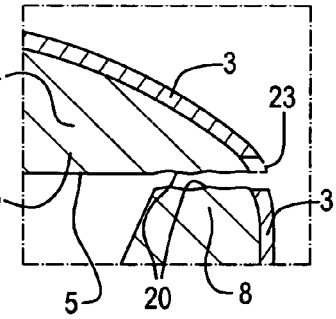

As represented in FIGS. 6 to 8, the mutual separability of the respective portions 4-8 of the finishing profiles of the present invention, as in the examples of FIGS. 1 to 4, has been obtained in that they, in the unseparated condition, are connected to each other by means of a break-off or cut-off zone 18. To this aim, both portions 4-8 in this case are connected to each other solely by a limited material portion 19 of the body 2.

As represented in FIG. 7, the break-off or cut-off zone 18 applied according to the invention preferably allows an easy separation of the respective portions 4-8. By an easy separation is meant that the respective portions 4-8 may be separated without using a tool or possibly by means of simple manual tools, such as a knife. As represented in FIG. 7 by arrow R, the separation simply takes place by rotating the nose portion 8 in respect to the flange-shaped portion 4. It is clear that the separation may also be obtained by performing the rotation R towards this attachment portion 6 instead of, as shown, away from the attachment portion 6. A separation, such as in FIG. 7, is possible, for example, when the material 19 of the break-off zone 18 can easily be torn off or split, for example, when the material relates to MDF or HDF. It is known that MDF or HDF offers only a limited resistance against splitting forces. Also other materials which are easy to split may be used to this aim. It is noted that also materials, which are more resistant against splitting forces, can be used. Possibly, notches may be provided in the break-off zone 18, with the intention of promoting the splitting or tearing.

As represented in FIG. 8, it is possible that after separation, a rough surface 20 remains on the separated portions 4-8. These surfaces 20 possibly may be treated in a simple manner, for example, with abrasive paper. Preferably, the break-off zone or cut-off zone 18, irrespective of how it is implemented, globally shows a maximum section S, which is smaller than 3 millimeters, and still better is two millimeters or smaller. By limiting the maximum section S of the break-off zone or cut-off zone 18, it is achieved that the size of the aforementioned rough surface 20 is restricted and/or that the respective portions 4-8 can be separated from each other more easily. For example, a rough surface 20 may be very disturbing when it remains on the aforementioned remaining portion 15 of the finishing profile 1.

The particularity of the finishing profiles 1 of the present invention lies in the fact that said layer-shaped covering 3 shows an interruption 21 at the height of the transition 22 between the portions that are made separable, in this case, between the flange-shaped portion 4 and the nose portion 8. In the example of FIG. 1, a preferred form of embodiment is concerned, in which the interruption 21 is also situated at the height of said break-off or cut-off zone 18. As aforementioned, a qualitatively better result can be obtained by applying the interruption 21 after the separation of the respective portions 4-8, in particular in respect to the quality of the edge of the layer-shaped covering 3 itself.

According to the invention, said interruption 21 of the layer-shaped covering 3 at the height of the transition 22 preferably is provided locally. Herein, the distance O between two portions of the layer-shaped covering 3 preferably is smaller than one millimeter. By the close adjoining of both portions of the layer-shaped covering is obtained that the interruption 21 of the layer-shaped covering 3 is experienced as less disturbing by the user of such finishing profile 1, whereas still a good result is obtained with a possible separation of the respective portions 4-8.

In FIGS. 6 and 8, in dashed line a variant is represented in which the interruption 21 is rendered hardly visible.

Figure 9:
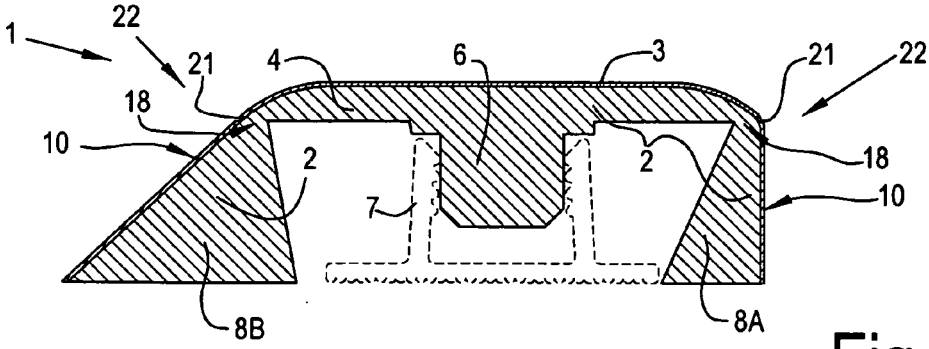
FIG. 9 represents another variant of a finishing profile according to the invention.

FIG. 9 represents another particular variant of a finishing profile 1 according to the invention. The respective finishing profile 1 comprises a body 2 with three portions 4-8A-8B, amongst which, on the one hand, a flange-shaped portion 4 with an attachment portion 6 situated at the bottom side 5, and, on the other hand, two nose portions 8A-8B extending, at opposite sides of the flange-shaped portion 4, downward and/or laterally of said flange-shaped portion 4. The two nose portions 8A-8B relate to, on the one hand, a nose portion 8A similar to the nose portion 8 represented in FIG. 1, and, on the other hand, a nose portion 8B similar to the nose portion 8 represented in FIG. 3. The flange-shaped portion 4 and the two nose portions 8A-8B of FIG. 9 are connected to each other in a mutually separable manner via a break-off or cut-off zone 18. At the height of each of the transitions 22 between said three portions 4-8A-8B, the layer-shaped covering 3 provided on the body 2 locally shows interruptions 21. It is clear that by separating one or more of the portions 8A-8B, various utilization possibilities are created, for example, those represented in FIGS. 2, 4 and 5.

Figure 10:
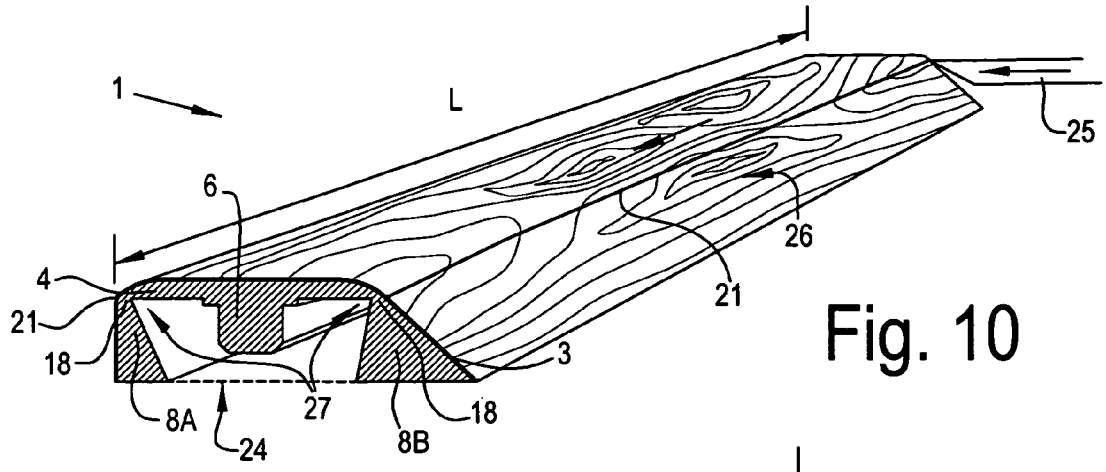
FIGS. 10 and 11, in perspective view, represent further variants of the finishing profile, as well illustrate methods for manufacturing finishing profiles according to the invention.

FIG. 10 represents an example of a finishing profile according to the invention, wherein the layer-shaped covering 3, at the height of said transition 22 or break-off zone 18, transitions 22 or break-off zones 18, respectively, shows an interruption 21, interruptions 21, respectively, over the entire length L of the finishing profile 1.

Figure 11:
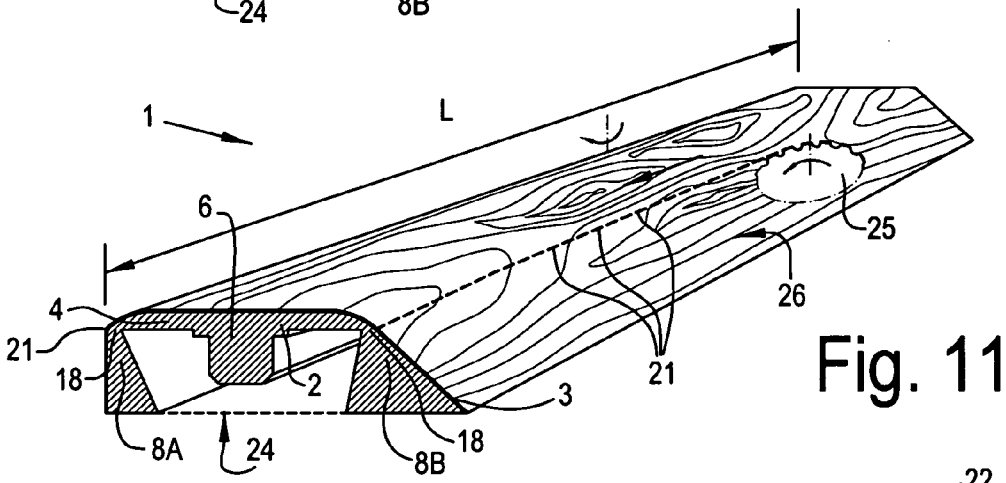

FIG. 11 represents another example of a finishing profile 1 according to the invention, wherein the layer-shaped covering 3, at the height of said transition 22 or break-off zone 18, transitions 22 or break-off zones 18, respectively, shows an intermittent interruption 21, interruptions 21, respectively, over the entire length L of the finishing profile 1.

It is evident that according to the invention, the interruption 21 of the layer-shaped covering 3 may also be performed solely over a part of the length L of the finishing profile 1.

It is noted that FIGS. 10 and 11 also represent methods for manufacturing a finishing profile 1 of the invention according to the first possibility, mentioned in the introduction, of such methods.

FIG. 10 shows that according to this first possible manufacturing method, it is started from a carrier that has already been provided with a layer-shaped covering 3, said carrier being represented in dashed line 24, from which carrier said body 2 is formed or is being formed. Herein, the layer-shaped covering 3 originally has been provided on the portions 4-8A-8B, which are made in a separable manner, of the body 2. As represented, the aforementioned interruption 21 at the height of the transition 22 or break-off zone 18 is obtained by performing an incision in the layer-shaped covering 3, for example, by means of a knife or other cutting element 25. According to a particular variant, the incision is made by means of a cutting beam, such as a laser beam. This particular variant may result in a very accurate cut or interruption 21, which hardly is visible to the user.

It is clear that the finishing profile 1 of FIG. 10 as such may be obtained according to said first possibility as well as according to said second possibility of methods for manufacturing such finishing profiles 1.

However, a pattern 26 extending practically continuously over the interruption 21 or transition 22, as in this case, can be obtained more easily according to the first possibility illustrated here.

FIG. 11 shows that according to a variant of this first possibility an intermittent interruption 21 may be obtained, for example, by employing a cutting element 25 in the form of a serrated cutting wheel. Here, too, according to a particular variant a cutting beam, such as a laser beam, may be utilized. It is clear that this beam then preferably is controlled in a pulsating manner. It is noted that in this example, also a pattern is obtained that extends practically continuously over the interruption 21 or transition 22.

Figure 12:
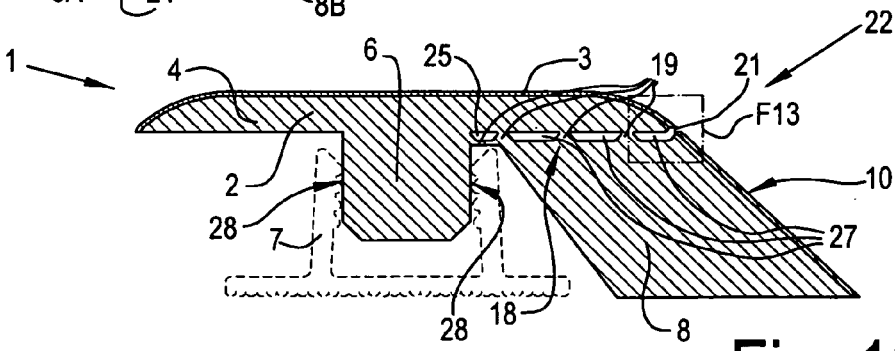
FIGS. 12 and 13 show another variant of a finishing profile according to the invention, wherein FIG. 13, at a larger scale, represents the part indicated by F13 in FIG. 12.

The variant of FIG. 12 relates to a finishing profile with a body 2, which latter can be obtained, for example, by extrusion. Here, the mutual separability of the nose portion 8 and the flange-shaped portion 4 has been obtained in that the body 2, at the height of said break-off or cut-off zone 18, is provided with recesses 27. Further, the particularity of this variant is that the break-off or cut-off zone 18, instead of being provided directly beneath the layer-shaped covering 3, is provided closer to the attachment portion 6 of the flange-shaped portion 4. It is noted that, according to the invention, the break-off or cut-off zone 18 may be situated at any location and may be performed in any manner. Thus, for example, it is not excluded that a nose portion 8 also is connected or solely is connected to an attachment portion 6 situated at the bottom side 5 of a flange-shaped portion 4. In such connection, the portions 4-8 may be interconnected, for example, via a break-off or cut-off zone 18 situated at a lateral wall 28 of the respective attachment portion 6.

Figure 13:
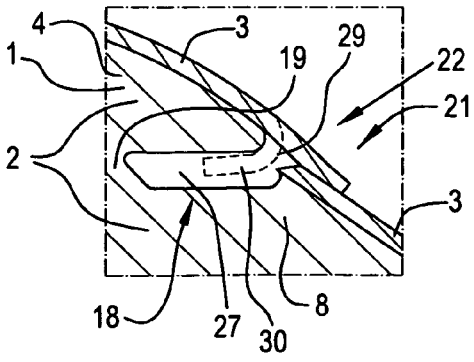

FIG. 13 shows another variant, wherein the layer-shaped coverings 3 of the separable-made portions 4-8 are made overlapping. Hereby, it is achieved that the interruption 21 of the layer-shaped covering 3 is almost invisible to the user. In dashed line 29, a further variant is represented, wherein the layer-shaped covering shows an inwardly-folded portion 30.

Figure 14:
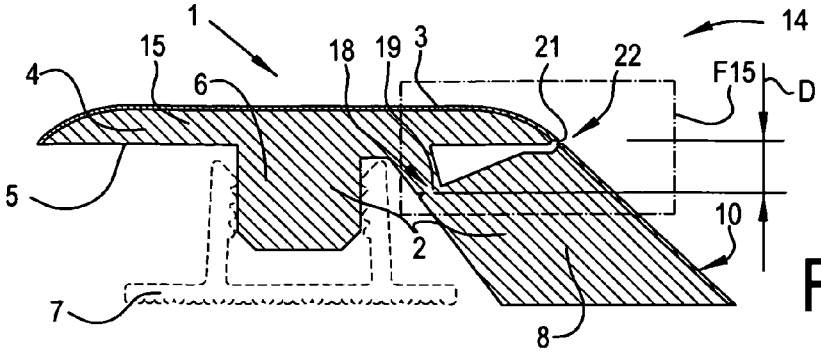
FIGS. 14 to 16 represent other variants, wherein FIG. 15 to 16, at a larger scale, represent the part indicated by F15 in FIG. 14.

FIG. 14 shows a variant of a finishing profile 1 according to the invention, wherein the aforementioned interruption 21, contrary to the examples from FIGS. 1 to 13, is not situated at the height of the break-off or cut-off zone 18, however, is provided at a certain vertical distance D from this break-off or cut-off zone 18.

Figure 15:
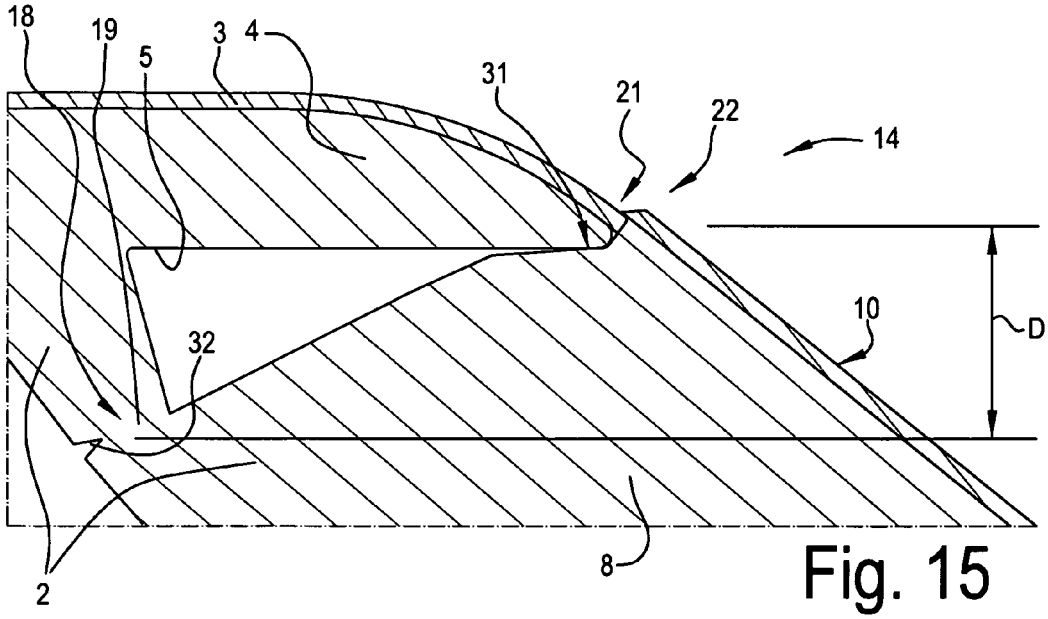

FIG. 15 shows still a further variant of the finishing profile 1 represented in FIG. 14. The finishing profile 1 allows that the flange-shaped portion 4 in use forms a contact surface 31 with the nose portion 8. The respective contact surface 31 may be created, for example, as a result of the nose portion 8, when the finishing profile 1 is subjected to a load or after the finishing profile 1 has been fixedly pressed into the holder 7, being slightly turned in respect to the flange-shaped portion 4. Further, it is clear from FIG. 15 that optionally a notch 32 may be provided at the height of the break-off or cut-off zone 18, which notch, as also mentioned above, promotes the separation of the nose portion 8.

Figure 16:
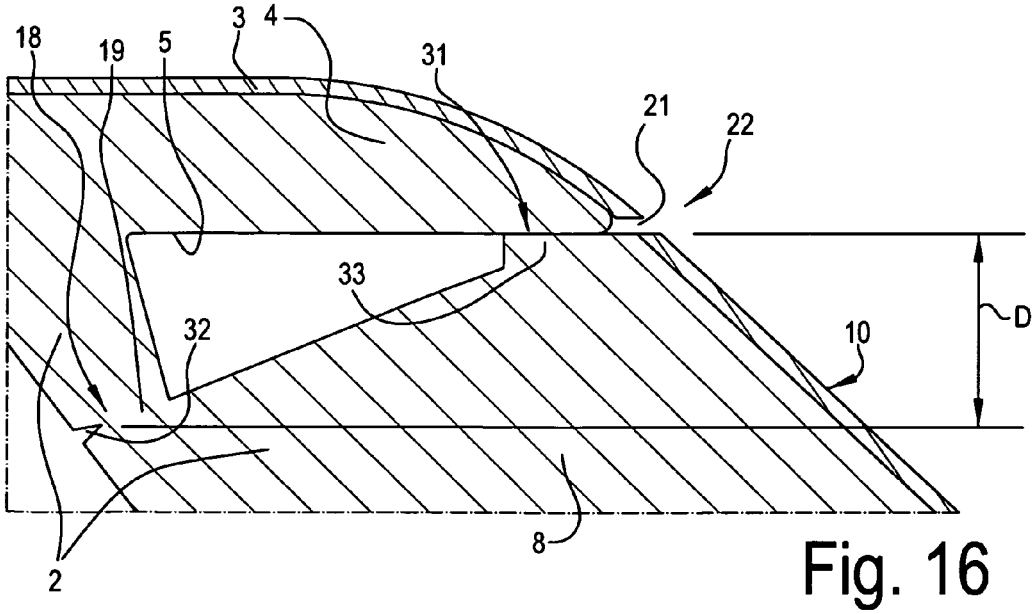

FIG. 16 shows a variant, wherein the contact surface is formed on a support portion 33 provided in particular to this aim. Preferably, for forming this contact surface, only a small turning, and still better no turning at all, of the nose portion 8 in respect to the flange-shaped portion 4 must be performed.

It is noted that for manufacturing the bodies of the finishing profiles from FIGS. 12 to 16, preferably a technique such as extrusion is applied.

The present invention is in no way limited to the forms of embodiment described by way of example and represented in the figures, on the contrary may such finishing profiles 1 and methods for the manufacture thereof be performed according to various variants, without leaving the scope of the invention.

The invention claimed is:

1. Finishing profile for a floor covering, comprising a body comprising at least two portions made separable from each other, which portions, in their unseparated condition, are continuously and integrally connected to each other by a break-off or cut-off zone, one of said two separable portions comprises a flange-shaped portion with an attachment portion located on a bottom side having generally lateral walls, the other of said two separable portions defining a nose portion forming an internal surface extending obliquely and outwardly relative to the lateral walls of the attachment portion, a clearance is defined between the lateral wall of the attachment portion and the internal surface of the nose portion such that the nose portion gradually tapers in width along the internal surface from a bottom portion toward a top portion of the nose portion, the break-off or cut-off zone defined at the top portion of the nose portion with the break-off or cut-off zone spaced between an outer periphery of the body and the internal surface of the nose portion;

wherein, by separating at least one portion from at least one other portion of the body, various applications of the other portion of the body are enabled;

wherein, at least on the two portions of the body, a layer-shaped covering is provided thereover and forms the outermost surface of the finishing profile; and wherein said layer-shaped covering has an interruption extending through the depth of the layer-shaped covering at least over part of the length of the finishing profile at a level where the transition between said two portions exists in the unseparated condition;

wherein the interruption is defined by opposed edges of the layer-shaped covering spaced apart by a distance from one another, the interruption terminating along the outer periphery of the body;

wherein the nose portion is arranged for splitting at the break-off or cut-off zone by rotating the bottom portion of the nose portion relative to the flange-shaped portion such that the break-off or cut-off zone is configured so that it cannot resist splitting forces formed due to rotation of the nose portion.

2. The finishing profile of claim 1, wherein said interruption is located at the level of said break-off or cut-off zone.

3. The finishing profile of claim 1 or 2, wherein said body comprises at least three portions, including the flange-shaped portion with the attachment portion located at a bottom side, the nose portion and an additional nose portion, the two nose portions extending, at opposite sides of the flange-shaped portion, either or both downwardly and laterally of said flange-shaped portion.

4. The finishing profile of claim 1 or 2, wherein the mutual separability of said portions is enabled by providing the body, at the level of said break-off zone or zones, with a recess.

5. The finishing profile of claim 1 or 2, wherein said layer-shaped covering comprises a laminate.

6. The finishing profile of claim 1 or 2, wherein said interruption of the layer-shaped covering at the level of the transition is provided locally and wherein the spacing between both portions of the layer-shaped covering is smaller than one millimeter.

7. Method for manufacturing the finishing profile of claim 1 or 2, wherein, starting from a carrier from which said body is formed and which is to be provided, at least partially, with said layer-shaped covering, providing said layer-shaped covering on the two mutually separable portions of the body as a whole; and providing said interruption after the application of the layer-shaped covering to the body.

8. Method for manufacturing the finishing profile of claim 1 or 2, wherein, starting from a carrier from which said body is formed and which is to be provided, at least partially, with said layer-shaped covering, providing said layer-shaped covering separately on each of the two mutually separable portions of the body.

9. The method of claim 7, wherein said body is formed from said carrier after the layer-shaped covering has been provided.

10. The method of claim 8, wherein said body is formed from said carrier after the layer-shaped covering has been provided.

11. The finishing profile of claim 1, wherein the interruption extends discontinuously over the entire length of the finishing profile.

12. The finishing profile of claim 1, wherein the body is formed from a material selected from the following group consisting of wood particles and a binding agent, medium-density fiberboard (MDF), high-density fiberboard (HDF), plywood, paper pulp, and synthetic material.

13. The finishing profile of claim 1, wherein the interruption lies on a substantially horizontal plane intersecting the break-off or cut-off zone.

14. The finishing profile of claim 1, wherein the layer-shaped covering includes a resin-immersed layer having abrasion resistant hard particles.

15. The finishing profile of claim 1, wherein the attachment portion has a greater width than the nose portion on a substantially horizontal plane intersecting the break-off or cut-off zone.

* * * * *